US005670300A

United States Patent [19]

Fyson et al.

[11] Patent Number: 5,670,300

[45] Date of Patent: Sep. 23, 1997

[54] METHOD OF PROCESSING PHOTOGRAPHIC SILVER HALIDE MATERIALS

[75] Inventors: John Richard Fyson, Hackney; Gareth Bryn Evans, Potten End, both of United Kingdom

[73] Assignee: Eastman Kodak Company, Rochester, N.Y.

[21] Appl. No.: 694,610

[22] Filed: Aug. 9, 1996

[30] Foreign Application Priority Data

Aug. 12, 1995 [GB] United Kingdom ..... 9516578

[51] Int. Cl.[6] ..... G03C 7/407

[52] U.S. Cl. ..... 430/373; 430/414; 430/430; 430/455; 430/461; 430/943

[58] Field of Search ..... 430/373, 414, 430/430, 455, 461, 943

[56] References Cited

U.S. PATENT DOCUMENTS 5,354,647 10/1994 Fyson ..... 430/393

FOREIGN PATENT DOCUMENTS

| | | |
|---|---|---|
| 0 620 488 A2 | 4/1993 | European Pat. Off. . |
| 2 113 414 | 1/1983 | United Kingdom . |
| 90/13060 | 11/1990 | WIPO . |
| 91/12567 | 8/1991 | WIPO . |
| 92/07300 | 4/1992 | WIPO . |

*Primary Examiner*—Hoa Van Le
*Attorney, Agent, or Firm*—J. Lanny Tucker

[57] ABSTRACT

A redox amplification photographic process comprises a sulfite fixing step after development-amplification and prior to peroxide bleaching.

12 Claims, No Drawings

METHOD OF PROCESSING PHOTOGRAPHIC SILVER HALIDE MATERIALS

FIELD OF THE INVENTION

This invention relates to the processing of color materials including a redox amplification step.

BACKGROUND OF THE INVENTION

Redox amplification processes have been described, for example in British Specification No. 1,268,126, U.S. Pat. No. 3,748,138, U.S. Pat. No. 3,822,129, U.S. Pat No. 4,097,278. In such processes color materials are developed to produce a silver image (which may contain only small amounts of silver) and then treated with a redox amplifying solution (or a combined developer-amplifier) to form a dye image.

The developer-amplifier solution contains a color developing agent and an oxidizing agent that will oxidize the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide or persulfates; cobalt (III) complexes including cobalt hexammine complexes; and periodates. Mixtures of such compounds can also be used.

In conventional processing (non-RX) of color materials, a bleach-fix bath which both bleaches silver image and removes all silver from the material is employed. Such solutions typically contain ferric EDTA complexes that are considered environmentally undesirable.

In the field of low silver coverage photographic materials intended for redox amplification (RX) processes it has been proposed to use a fixer comprising an alkali metal sulfite as fixing agent and a bleach comprising a peroxide and an alkali metal halide. These proposals are described in European Publications 0,540,619, 0,506,909, and 0,470,083. Both sulfites and hydrogen peroxide are environmentally acceptable.

Because of the small amounts of silver present in the photographic material it has also been proposed to leave out the processing stages that bleach and fix because the degradation of the image is minimal. However, if it is desired to gain the highest quality image, all image silver has to be removed so that it does not degrade the dye images (especially the yellow image) and unreduced silver halide has similarly to be removed so that it does not darken or print out with time.

It has been found that when using a bleach-fix bath after an RX step, a stop bath must be interposed otherwise staining occurs. A stop bath may be dispensed with if the RX step is followed by a fixer bath.

If the redox amplification is immediately followed by a bleach bath, redox amplification can continue in the bleach bath leading to poorly controlled sensitometric results.

The present invention seeks to provide a high quality process after the formation of the amplified dye image so that image degradation caused by image silver or unreduced silver halide is eliminated without using environmentally unfriendly processing solutions and without increasing processing time.

SUMMARY OF THE INVENTION

According to the present invention there is provided a method of processing an imagewise exposed photosensitive photographic silver halide color material comprising a silver halide emulsion having at least 85% silver chloride and having a total silver coating weight of 10 to 500 mg/m$^2$, comprising treating the material with the following processing baths order:

(a) a developer-amplifier solution containing a color developing agent and hydrogen peroxide or a compound that yields hydrogen peroxide, (b) a fixer comprising an alkali metal sulfite, or a material that yields sulfite, as fixing agent, (c) a bleach comprising hydrogen peroxide or a compound that yields hydrogen peroxide and an alkali metal halide wherein the pH is in the range 8–11.

We have now found that if an RX step is followed by a sulfite fixer and then a peroxide bleach, the remaining unfixed rehalogenated silver is not sensitive to light and can be left in the material without causing any unwanted darkening.

In spite of the material having no fix step after the bleach, the silver salt remaining in the material is not sensitive to light and no print out occurs.

DETAILED DESCRIPTION OF THE INVENTION

Useful developer-amplifier solutions are described above. They generally have a pH of from 9 to 13, and comprise a useful color developing agent and suitable oxidizing agent, such as hydrogen peroxide.

The sulfite fixer may contain from 20 to 150 g/l of the alkali metal sulfite (as sodium sulfite). Corresponding levels of materials that provide sulfite during processing, e.g., an alkali metal metabisulfite, can also be used. The fixer may have a pH above 6.4 , preferably of from 6.5 to 9, especially 7.0. A buffering material may be used, for example an alkali metal acetate in order to maintain the desired pH.

The bleach bath may contain 10 to 200 g/l, preferably 30 to 100 g/l of 30% w/w hydrogen peroxide solution. The bleach bath may also contain 0.5 to 30 g/l of alkali metal halide (as sodium chloride).

The bleach may also contain metal-chelating agents to which metals might otherwise catalyze the decomposition of the hydrogen peroxide. Such compounds may be of the 1-hydroxyethylidene-1, 1'-diphosphonic acid and/or diethyltriaminepentaacetic acid type.

The bleach preferably has a pH of from 8 to 11 and is preferably about 10. It may contain a buffer, for example an alkali metal carbonate.

The total processing time is preferably from 30 to 600 seconds, especially from 45 to 250 seconds.

The photographic elements can be single color elements or multicolor elements having a paper or a transparent film base. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in this invention, can have any of the components described in Research Disclosure Item 36544, September 1994, published by Kenneth Mason Publications, Emsworth, Hants P010 7DQ, United Kingdom.

The present processing solutions are preferably used in a method of processing carried out by passing the material to be processed through a tank containing a processing solution (any of those used in the invention) that is recirculated through the tank at a rate of from 0.1 to 10 tank volumes per minute.

The preferred recirculation rate is from 0.5 to 8, especially from 1 to 5 and particularly from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length ×width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. No. 5,294,956, U.S. Pat. No. 5,179,404, U.S. Pat. No. 5,270,762, EP-A-559,025, EP-A-559,026, EP-A-559,027, WO 92/10790, WO 92/17819, WO 93/04404, WO 92/17370, WO 91/19226, WO 91/12567, WO 92/07302, WO 93/00612, WO 92/07301, WO 92/09932 and U.S. Pat. NO. 5,436,118.

The following Example is included for a better understanding of the invention.

EXAMPLE

The photographic material used in this invention was a color paper with a total silver laydown of 65 $mg/m^2$. The material increasing the process length. This fixer maybe connected counter current with the fixer was exposed in a sensitometer at 1/10s through a 0.15 log wedge with correction filters added to try to get a neutral gray scale. The wedge also includes red, green and blue separations. To demonstrate the effects of improved color the blue separation (yellow dye) was measured on the processed strips in all three colors, retained silver showing up as increased density in all three layers.

The following solutions were made up to be used in the processes that follow:

| | |
|---|---|
| **Developer amplifier** | |
| 1-hydroxyethylidene-1,1'-diphosphonic acid | 0.6 g |
| diethyltriaminepentaacetic acid | 2.0 g |
| Dipotassium hydrogen phosphate.$3H_2O$ | 40.0 g |
| Hydroxylamine sulfate | 0.5 g |
| 4-N-ethyl-N-(β-methanesulfonamidoethyl)-o-toluidine sesquisulfate | 4.5 g |
| Water to | 1 liter |
| pH adjusted to 11.7 with sodium hydroxide | |
| 20 ml 3% w/w hydrogen peroxide was added just before use | |
| **Thiosulfate Fixer** | |
| Sodium sulfite (anhydrous) | 20.0 g |
| Sodium thiosulfate.$5H_2O$ | 20.0 g |
| Sodium acetate | 40.0 g |
| Water to | 1 liter |
| pH adjusted to 5.5 with acetic acid | |
| **Sulfite Fixer** | |
| Sodium sulfite (anhydrous) | 50.0 g |
| Sodium acetate | 40.0 g |
| Water to | 1 liter |
| pH adjusted to 7.0 with sulfuric acid | |
| **Rehalogenating peroxide bleach 1** | |
| 1-hydroxyethylidene-1,1'-diphosphonic acid | 0.6 g |
| diethyltriaminepentaacetic acid | 2.0 g |
| Sodium chloride | 1.0 g |
| Sodium hydrogen carbonate | 20.0 g |
| Hydrogen peroxide (30%) | 50.0 g |
| Water to | 1 liter |
| pH adjusted to values in TABLE 1 with sodium hydroxide or sulfuric acid | |

-continued

| | |
|---|---|
| Rehalogenating peroxide bleach 2 | |
| 1-hydroxyethylidene-1.1'-di-phosphonic acid | 1.0 g |
| Sodium chloride | 20.0 g |
| Sodium hydrogen carbonate | 3.0 g |
| Sodium carbonate | 4.0 g |
| Hydrogen peroxide (30%) | 50.0 g |
| Water to | 1 liter |
| pH adjusted to 10.0 with sodium hydroxide or sulfuric acid | |
| Rehalogenating dichromate bleach | |
| Potassium dichromate | 10.0 g |
| Sodium chloride | 10.0 g |
| Sulfuric acid (concentrated) | 10 ml |
| Water to | 1 liter |
| Bleach-fix | |
| Ammonium iron (III) EDTA solution (1.56M) | 50 ml |
| Ammonium thiosulfate | 50 g |
| Sodium sulfite | 20 g |
| Acetic acid (glacial) | 15 ml |
| Water to | 1 liter |
| pH adjusted to 6.0 | |
| Stop bath | |
| Acetic acid (glacial) | 30 ml |
| Water to | 1 liter |

The following is a list of process used to test the invention. All were carried out at 35° C. It is indicated for each process whether it is a comparison or an example of the invention.

| | |
|---|---|
| Process 1 | |
| Developer amplifier | 45s |
| Stop | 45s |
| Bleach-fix | 45s |
| Wash | 60s |
| Dry | |
| Process 2 | |
| Developer amplifier | 45s |
| Bleach-fix | 45s |
| Wash | 60s |
| Dry | |
| Process 3 | |
| Developer amplifier | 45s |
| Thiosulfate fixer | 45s |
| Wash | 60s |
| Dry | |
| Process 4 | |
| Developer amplifier | 45s |
| Peroxide bleach 1 (pH 10.0) | 45s |
| Thiosulfate fixer | 45s |
| Wash | 60s |
| Dry | |
| Process 5 | |
| Developer amplifier | 45s |
| Thiosulfate fixer | 45s |
| Peroxide bleach 1 (pH 10.0) | 45s |
| Wash | 60s |
| Dry | |
| Process 6 | |
| Developer amplifier | 45s |
| Sulfite fixer | 45s |
| Peroxide bleach 1 (pHs 7 to 11) | 45s |
| Wash | 60s |
| Dry | |

-continued

| | |
|---|---|
| Process 7 | |
| Developer amplifier | 45s |
| Sulfite fixer | 45s |
| Peroxide bleach 2 | 45s |
| Wash | 60s |
| Dry | |
| Process 8 | |
| Developer amplifier | 45s |
| Sulfite fixer | 45s |
| Dichromate bleach | 45s |
| Wash | 60s |
| Dry | |
| Process 9 | |
| Developer amplifier | 45s |
| Stop | 45s |
| Peroxide bleach 2 | 45s |
| Wash | 60s |
| Dry | |

The results of the experiment are shown in Table 1:

TABLE 1

| Process | | Red Density | Green Density | Blue Density |
|---|---|---|---|---|
| 1 | comparison | 0.20 | 0.65 | 2.33 |
| 2 | comparison | 0.35 | 0.72 | 2.40 |
| 3 | comparison | 0.26 | 0.71 | 2.38 |
| 4 | comparison | 0.26 | 0.72 | 2.57 |
| 5 | comparison | 0.27 | 0.70 | 2.37 |
| 6 (bleach pH = 7.0) | comparison | 0.25 | 0.69 | 2.36 |
| 6 (bleach pH = 8.0) | invention | 0.20 | 0.65 | 2.33 |
| 6 (bleach pH = 9.0) | invention | 0.20 | 0.65 | 2.34 |
| 6 (bleach pH = 10.0) | invention | 0.20 | 0.64 | 2.33 |
| 7 | invention | 0.19 | 0.65 | 2.32 |
| 8 | invention | 0.20 | 0.66 | 2.34 |
| 9 | comparison | 0.21 | 0.67 | 2.33 |

Process 1 is the control process and an aim for the best yellow hue with least red and green unwanted absorptions. This process involved a stop and an environmentally unfriendly bleach-fix but should not contain any silver in the image.

Process 2 results show the effect of having no stop between the developer amplifier and bleach-fix steps. A large amount of cyan stain was generated which showed over the whole strip.

Process 3 results show the yellow image densities when all the silver developed was present as this had only been fixed. When compared to Process 1 we see an increase in density in all layers due to the unwanted silver adsorption.

Process 4 results show much increased yellow density with similar red and green densities to Process 3 but the yellow color appeared 'cleaner' implying there was less silver in the image. However more color density was formed as the RX development continued into the bleach that was acting as an amplifier.

Process 5 results are similar to those of process 3 and silver appears to have been retained. The bleach does not appear to be working after the thiosulfate fixer.

Process 6 with the bleach pH at 7.0 results look like those of Process 3 and silver is retained. This suggests that the bleach does not work at this pH for at higher pHs the results are similar to those of process 1 and the yellow is 'cleaner' with less unwanted neutral color. The sulfite fixer does not inhibit the bleaching at pHs>8.0

Process 7 appears to work as well as Process 6 with the bleach at pH>8.0 as does process 8 with a dichromate bleach. This latter may not be environmentally acceptable but this bleach does remove the silver.

Process 9 has all the silver retained with no fixer. The yellow density is similar to that of process 1 and the silver appears to have been bleached.

In order to test the strips to see if the image would print-up in sunlight, after initial sensitometric reading, each of the strips from the experiment was taped to a south facing window at midday in bright sunshine for one hour. The strips were read again and the differences recorded in Table 2 below.

TABLE 2

| Process | | Red Density | Green Density | Blue Density |
|---|---|---|---|---|
| 1 | comparison | 0.00 | 0.00 | 0.01 |
| 2 | comparison | 0.00 | −0.01 | 0.00 |
| 3 | comparison | 0.00 | −0.01 | 0.00 |
| 4 | comparison | −0.01 | 0.00 | 0.00 |
| 5 | comparison | 0.00 | 0.00 | −0.01 |
| 6 (bleach pH = 7.0) | comparison | 0.00 | 0.01 | 0.00 |
| 6 (bleach pH = 8.0) | invention | 0.00 | 0.00 | 0.00 |
| 6 (bleach pH = 9.0) | invention | 0.01 | 0.00 | 0.00 |
| 6 (bleach pH = 10.0) | invention | −0.01 | 0.01 | 0.00 |
| 7 | invention | 0.00 | 0.00 | 0.01 |
| 8 | invention | 0.01 | 0.00 | 0.00 |
| 9 | comparison | 0.04 | 0.05 | 0.04 |

The only process that was seriously affected by sunlight was process 9. This had had no fixing step and all the silver halide was retained. The silver printed out over all the strip. It might be expected for reasons on consistency that strips from processes 6 (pH>8.0), 7 and 8 would have printed out in image areas as silver halide should have been retained in such areas, but it appeared to be insensitive to sunlight thus demonstrating the invention.

In order to check that the silver halide was retained in Process 6 (pH>8), Process 7 and Process 8 but was insensitive to sunlight a drop of 0.5% sodium sulfide solution was applied to the yellow image areas. It immediately caused an increase in density with the formation of silver sulfide, indicating the presence of retained, but light insensitive silver halide.

The invention has been described in detail with particular reference to preferred embodiments thereof, but it will be understood that variations and modifications can be effected within the spirit and scope of the invention.

We claim:

1. A method of processing an imagewise exposed photosensitive photographic silver halide color material comprising a silver halide emulsion having at least 85% silver chloride and having a total silver coating weight of 10 to 500 mg/m$^2$, comprising treating said material with the following processing baths in order:

(a) a developer-amplifier solution containing a color developing agent and hydrogen peroxide or a compound that yields hydrogen peroxide, (b) a fixer comprising an alkali metal sulfite or a material that yields sulfite as fixing agent, (c) a bleach comprising hydrogen peroxide or a compound that yields hydrogen peroxide and an alkali metal halide wherein the pH is in the range 8–11.

2. The method of claim 1 wherein said developer/amplifier has a pH of from 9 to 13.

3. The method of claim 1 wherein said fixer comprises 20 to 150 g/l of alkali metal sulfite (as sodium sulfite).

4. The method of claim 3 wherein said alkali metal sulfite is the sole fixing agent in said fixer.

5. The method of any of claim 1 wherein said bleach contains from 10 to 200 g/l of hydrogen peroxide (30% w/w).

6. The method of claim 1 wherein said bleach contains from 1 to 50 g/l of alkali metal halide (as sodium chloride).

7. The method of claim 1 wherein said bleach has a pH of from 8 to 11.

8. The method of claim 1 wherein the total silver coating weight in said material is from 50 to 200 mg/m$^2$.

9. The method of claim 1 in the total processing time is from 30 to 600 sec at 35° C.

10. The method of claim 1 carried out by passing said material through a tank containing a processing solution that is recirculated through said tank at a rate of from 0.1 to 10 tank volumes per minute.

11. The method of claim 1 carried out in a machine wherein the ratio of tank volume to maximum area of said material accommodatable therein is less than 11 dm$^3$/m$^2$.

12. The method of claim 11 carried out in a machine wherein the ratio of tank volume to maximum area of said material accommodatable therein is less than 3 dm$^3$/m$^2$.

* * * * *